United States Patent [19]

Gates

[11] Patent Number: 4,865,186

[45] Date of Patent: Sep. 12, 1989

[54] EYEGLASS AND CONTACT LENS CONTAINER

[76] Inventor: Jeffrey Gates, 819 S. Sycamore Ave., Los Angeles, Calif. 90036

[21] Appl. No.: 264,391

[22] Filed: Oct. 31, 1988

[51] Int. Cl.[4] ..... A45C 11/04

[52] U.S. Cl. ..... 206/5; 206/5.1; 206/6

[58] Field of Search ..... 206/5, 5.1, 6

[56] References Cited

U.S. PATENT DOCUMENTS 3,124,240 3/1964 Croan ..... 206/5
3,825,110 7/1974 Halbich et al. ..... 206/6

FOREIGN PATENT DOCUMENTS 271788 6/1927 United Kingdom ..... 206/6
437025 10/1934 United Kingdom ..... 206/6

*Primary Examiner*—William Price
*Attorney, Agent, or Firm*—Plante, Strauss, Vanderburgh

[57] ABSTRACT

A case for eyeglasses and for contact lenses is formed as a shell of substantially rigid plastic with a cover member and a base member which are hinged together along a longitudinal side edge. The case also has a partition that is also hinged and is formed of semi-flexible plastic or is a laminate of a formed plastic foam member and a plate member of substantially rigid plastic.

11 Claims, 3 Drawing Sheets

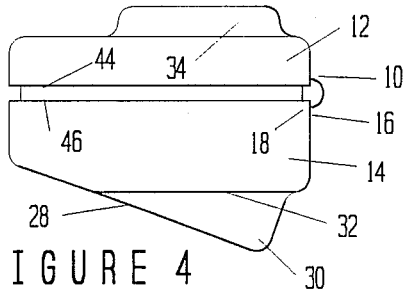
FIGURE 4
FIGURE 5
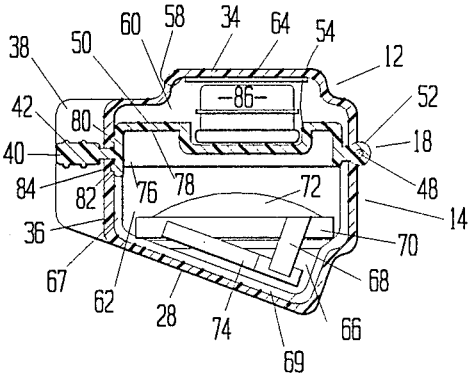
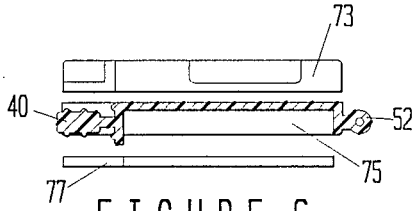
FIGURE 6

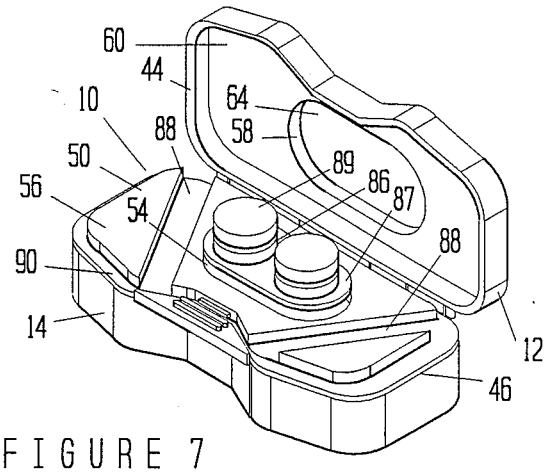
FIGURE 7
FIGURE 8
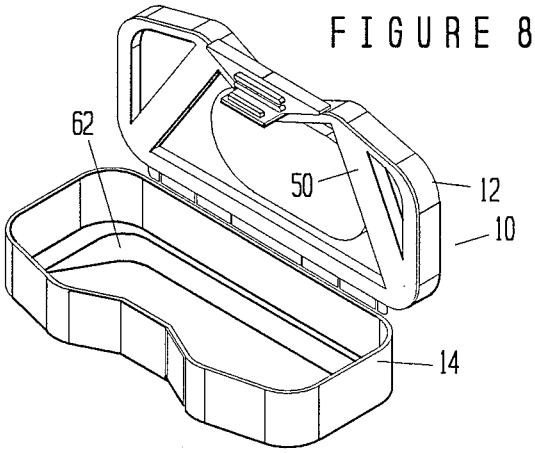

EYEGLASS AND CONTACT LENS CONTAINER

BACKGROUND OF THE INVENTION

1. Field of Invention

This invention relates to a container for eyeglasses, and in particular, to a container for both eyeglasses and contact lenses.

2. Brief Statement of the Prior Art

Various containers have been proposed for contact lenses. U.S. Pat. No. 3,186,540 discloses a ventilated dry-type contact lens case which is specifically designed for receiving and storing contact lenses. U.S. Pat. No. 3,326,358 also discloses a container for storing contact lenses and containers of cleaning fluid for the contact lenses. Other contact lens holding devices are shown in U.S. Pat. Nos. 3,645,284 and 3,623,492 which disclose containers for contact lenses that include mechanisms for cleansing the lenses in the containers.

Containers have been devised for storing multiple eyeglass frames such as disclosed in U.S. Pat. Nos. 3,323,638 and 3,144,127. Additionally, an eyeglass frame has been patented which includes cavities for storing contact lenses: see U.S. Pat. No. 3,663,099. A failing of all of the various prior art devices for storing either contact lenses or eyeglass frames is that there is no provision for a compact case for storing both eyeglass frames and contact lenses, as well as containers of treating fluids such as eye drops and cleansing liquids necessary for the contact lenses. This is a substantial shortcoming in the prior art as many contact lens wearers also wear conventional eyeglasses and a need exists to store these items at a convenient and compact container, particularly a container which has separate compartments for each.

BRIEF DESCRIPTION OF THE DRAWINGS

The invention will be described with reference to the FIGURES, of which:

FIG. 4 is an end view of the case of FIG. 1;

FIG. 5 is a view along line 5—5′ of FIG. 2;

FIG. 6 is an exploded cross sectional view of an alternative partition member for the case of the invention;

FIG. 7 is a perspective view of the case of the invention opened to the contact lens compartment; and FIG. 8 is a perspective view of the case of the invention opened to the eyeglass compartment.

BRIEF DESCRIPTION OF THE INVENTION

Figure 1:
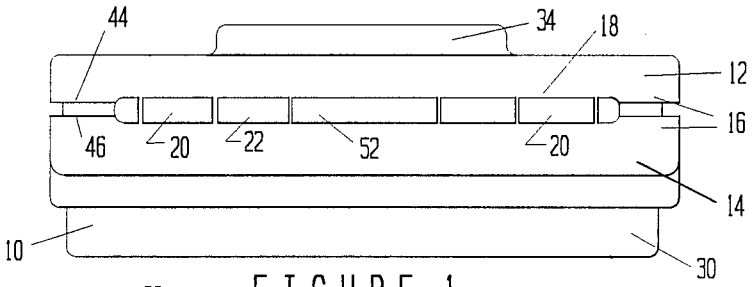
FIG. 1 is a rear view of the case of FIG. 1.
Figure 2:
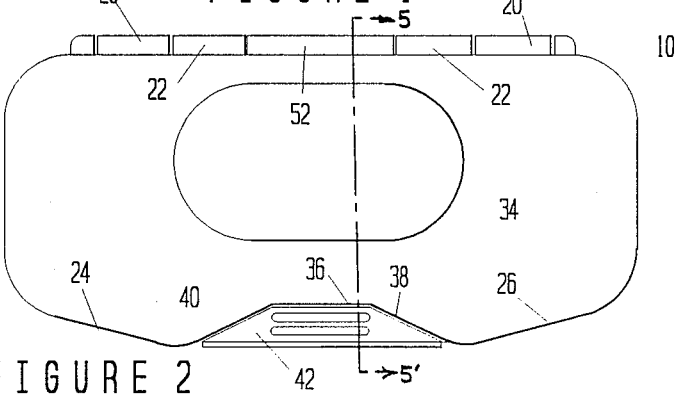
FIG. 2 is a front view of the case of FIG. 1.

This invention comprises a case for eyeglasses and for contact lenses. The case is formed as a shell of substantially rigid plastic with a cover member and a base member which are hinged together along a longitudinal side edge. The case also has an internal, transverse partition that is formed of semi-flexible plastic or is a laminate of a formed plastic foam member and a plate member of a substantially rigid plastic. Alternatively, the entire member can be of a single plastic such as a suitable soft elastomer. The partition, also, is hinged in the case along a side edge.

The partition subdivides the internal compartment of the case into an upper, contact lens compartment and a lower, or base compartment for a pair of eyeglasses. The partition has, on its contact-lens-compartment surface, a recess of the size to receive a conventional contact lens container. Preferably, the top cover of the case has a central raised boss which forms a recess on its inside surface and which is positioned opposite the recess in the partition that receives the contact lens container. The partition supports a case access lever from its edge that is opposite its hinged edge and that extends between the opposing edges of the cover and base members, whereby the lever can be used to gain access to either the eyeglass compartment or the contact lens compartment. Preferably the contact lens compartment side of the partition also has one or more additional recesses of a size and shape to receive the conventional containers or capsules of liquids, such as eye drops or cleansing liquids, used for treatments associated with contact lenses.

DESCRIPTION OF PREFERRED EMBODIMENT

Referring now to FIGS. 1 through 4, the case 10 of the invention is a generally rectangular shaped shell having a cover member 12 and a base member 14 which are hinged together along one longitudinal side edge 16 of each. For this purpose a hinge structure 18 is provided which is substantially coextensive the longitudinal side edge 16 with hinge blocks 20 that are carried on the base member 14 adjacent to hinge blocks 22 carried on the cover member 12.

The case has rounded or filleted corners and, preferably, has tapered opposite front edges 24 and 26. The base member 14 has an inclined bottom wall 28 forming an angular protuberance 30 on the undersurface 32 of the case 10. As described hereinafter this protuberance 30 provides storage for the temples of a conventional eyeglass frame. The cover member 12 has a central, raised protuberance 34 which is centrally located. This structure provides a significant reduction in the overall volume and mass of the container.

The forward face 36 of the case 10 has a central, transverse recess 38 which receives a trapezoidal-shaped handle 40 which can have a plurality of ridges 42 to facilitate grasping by the user.

The aforementioned case 10 is formed of a rigid, hard and crush-resistant plastic. Examples of suitable materials are rigid such as polyethylene, polypropylene, polyvinyl chloride, acrylonitrile-butadiene-styrene, etc.

Figure 3:
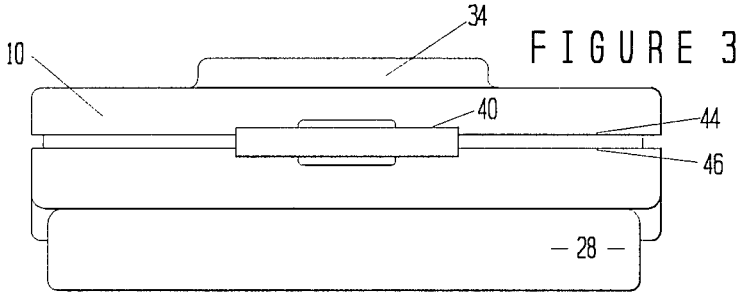
FIG. 3 is a top plan view of the eyeglass and contact lens container of the invention.

Referring to FIGS. 1, 3 and 4, the opposed edges 44 and 46 of the cover member 12 and base member 14 do not abut but are separated entirely by a slight distance which is the thickness of the internal partition of the case. The structure of the partition and the interior of the case will be apparent from the following description.

Referring now to FIG. 5, there is illustrated a sectional view along the midline of the case. As there illustrated, the cover member 12 is hinged to the base member 14 along a continuous hinge 18 having a hinge pin 48. The partition member 50 of the case 10 is also attached to the case with hinge 18, having a hinge block 52 (see FIGS. 1 and 2) that also receives the hinge pin 48. The partition member 50 extends transversely the case, spanning the entire interior of the case, subdividing it into an upper compartment 60 and a lower compartment 62. The partition supports the handle 40 that extends beyond the recess 38 in the forward face 36 of the cover member 12 and base member 14. A recess 54 is formed on the upper compartment side 56 of the partition 50. As previously noted, the cover member 12 also has a central raised protuberance 34 which forms a recess 58 on its inside surface, within the upper compartment 60. A mirror 64 is preferably secured on the inside wall of recess 58.

As previously mentioned, the bottom wall 28 of the case 10 is inclined outwardly to form a recess 66 in the lower compartment 62. This recess 66 is substantially, but not entirely, coextensive with the bottom wall 28 of the lower compartment 62. As illustrated, this compartment is a receptacle for a conventional eyeglass frame 68 having a standard frame 70 supporting a pair of ocular lenses 72 and a pair of hinged folding temples 74. The temples 74 are received in the recess 66 of the lower compartment 62, in the illustrated manner. Preferably, the entire compartment has a foamed plastic liner 67 and 69 which covers the sidewalls, and the bottom wall of the compartment 62. The liner can be formed by molding a single insert that fits into compartment 66 of the base member 14, or sheet layers of foam plastic having a pressure sensitive adhesive coating can be applied directly onto the bottom wall and side walls of the compartment 62 in the base member 14. The partition member 50 has a peripheral skirt 76 entirely surrounding its planer surface 78 and projecting downwardly therefrom. The aforementioned hinge block 52 and the handle 40 are outwardly dependent from the skirt 76 of the partition member 50. At its forward face, the partition skirt bears two pairs of beads 80 and 82, which are located on opposite sides of the handle 40. These beads are received in mating grooves 84 on the inside upright walls of the cover member 12 and base member 14, thereby providing closure detents for the case and for the upper compartment.

Referring now to FIG. 6, an alternative construction for the partition member is shown. This partition is a laminate of a central plate 75 which is molded of a suitable nonelastic elastic such as polyethylene, polyvinylchloride, etc. It has the handle 40 and hinge block 52, previously described. Its upper surface is planar and a molded plastic foam member 73 is adhesively bonded to its upper surface. The foam member 73 has the receptacle 54 and the channels 88, all previously mentioned. Preferably, a plastic foam sheet 77 is bonded to the underside of the partition member 75, thereby providing a foam liner on the cover of the lower compartment 62.

Referring now to FIG. 7, the case is illustrated with the cover member 12 opened, granting access to the upper compartment 60 of the case 10. As there illustrated, the partition member 50 has a central recess 54 of the shape and size to receive a conventional contact lens container 86 which has a base 87 and a pair of cylindrical cases 89 that are conventionally used for storage of contact lenses.

The recess 58 in the top wall of the cover member 12 also surrounds the contact lens cases 86 when the cover member 12 is closed. When the cover member 12 is open, as illustrated, the mirror 64 which lines the top surface of recess 58 is exposed and available for use.

Preferably, the partition member 50 has at least one, and most preferably, two channels 88 molded into its upper surface 56. These channels that span the width of the partition member 50, preferably diagonally oriented as shown to provide for maximum length of the channels. These channels receive the conventional containers such as tubes or bottles of treatment solutions customarily used with contact lenses. Although straight channels with parallel sidewalls are shown, it is apparent that the channels could be formed to duplicate the external shapes of various containers of treatment fluids, such as capsules or bottles of eye drops, cleansing fluids, etc.

The bottom edge of skirt 76 of the partition member 50 is flared outwardly as a peripheral flange 90 which entirely surrounds the skirt 76 of this member. This flange 90 is received between the opposed edges 44 and 46 of the cover member 12 and base member 14.

Referring now to FIG. 8, the cover member 12 and the partition member 50 are shown open, permitting access to the lower compartment 62 of the case 10. The foam liner 69 previously described and shown in FIG. 5 has been removed from compartment 62 to illustrate the inside walls of the base member 14. The case can be opened to the position shown in FIG. 7 by releasing the lower pair of beads 82 (see FIG. 5) from their mating grooves on the inside wall of the transverse recess 38 of the base member 14, and swinging the cover member 12 and partition member 40 open. The case of this invention provides a very safe and compact storage of both conventional eyeglass frames and contact lenses. The eyeglass frame and contact lenses are stored in separate compartments which are separated by a continuous partition and this partition has a handle projecting from the case which readily permits the user to access, selectively, either of the two compartments. In this manner the contents of the other compartments are not disturbed when the user gains access to a compartment for retrieving or restoring its contents. Each compartment is closed with a positive detent that is carried on the partition, thereby insuring that the partition serves as a closure member for both compartments. In the ordinary or normal use of the device, the user will grasp the handle and will raise or lower either the cover member or the base member to gain access to the compartments of each of these members. This practice insures that both compartments are not simultaneously opened, with the attendant risk of discharging or losing the contents of one compartment while seeking access to the other compartment.

The case for both the contact lenses and eyeglass frames is quite compact having no significantly greater thickness than the thickness of a conventional carrying case for eyeglass frames. Despite its compactness, the case provides storage for both contact lenses, treatment liquids for the contact lenses, and a conventional eyeglass frame. The contents of the case are protected against abuse by the rigidity and strength of the shell that is formed by the cover and base members. The lenses of the eyeglasses are protected against abrasion while mounted in the case by the inner partition which is formed of a semi-flexible, soft, plastic, preferably of a elastomer. Preferably, the partition is covered with a plastic foam lining, or most preferably, the partition is molded of a suitable plastic foam having sufficient compressibility to provide protection for the eyeglasses within the compartment 62. The foam also provides some retention for items such as bottles, tubes, or other containers which can be wedged within the channels 88. The same material also provides a peripheral seal that extends entirely about the open edges of the cover member and the base member, insuring that the compartments within these members are sealed from external dust and influence.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims.

What is claimed is:

1. A combined eyeglass and contact lens case comprising:

a. a base member having a bottom wall and perimeter upright base sidewalls of appropriate dimensions to permit storage of a pair of eyeglasses and frame therein;

b. a coextensive cover member having a top wall and perimeter upright cover sidewalls c. hinge means disposed along one longitudinal edge of each of said base and cover members for the hinged attachment of said cover to said base with the opposed edges of said base and cover sidewalls meeting along a planar surface intermediate the thickness of said case;

d. an inside, transverse partition supported within said case and supported along one side edge by said hinge means to subdivide the inside compartment of said case into a cover compartment and a base compartment;

e. at least a pair of generally circular recesses centrally located on the cover side of said partition to provide pockets in said partition for storage of contact lenses;

f. cover and base detent means on the edge of said partition opposite said one side edge with first and second coacting detent means on said cover and base members, respectively; and g. a latch arm dependent from said partition and positioned between said cover and base detent means whereby said partition can be opened from said cover member for access to said cover compartment.

2. The case of claim 1 wherein said latch arm projects beyond said sidewalls of said base compartment to permit use of said latch arm for access to said base compartment.

3. The case of claim 1 including at lease one additional recess on the cover side of said partition for storage of containers for lens and eye treatment solutions.

4. The case of claim 1 wherein said base and cover members are formed of rigid plastics.

5. The case of claim 1 wherein said partition is formed of an elastomer.

6. The case of claim 1 wherein said detents comprise a key on said opposite edge of said partition and said coacting detent means comprise first and second mating recesses to receive said key means.

7. The case of claim 1 wherein said cover member has an outwardly extending bulge to provide a cover member recess in said top cover opposite said pair of cylindrical recesses and thereby accommodate the thicknesses of contact lens containers.

8. The case of claim 2 wherein said additional recess is a rectangular recess of a size sufficient to receive an elongated container of liquid.

9. The case of claim 7 including at least two said rectangular recesses.

10. The case of claim 1 including a mirror permanently attached to the inside of said top wall.

11. The case of claim 6 including a mirror lining the inside of said cover member recess.

* * * * *